US009498079B2

(12) United States Patent
Sanchuk

(10) Patent No.: US 9,498,079 B2
(45) **Date of Patent: *Nov. 22, 2016**

(54) WINDOW TREATMENT MOUNTING ASSEMBLY

(71) Applicant: Carol Ann Sanchuk, Chatham (CA)

(72) Inventor: Carol Ann Sanchuk, Chatham (CA)

( * ) Notice: Subject to any disclaimer, the term of this patent is extended or adjusted under 35 U.S.C. 154(b) by 0 days.

This patent is subject to a terminal disclaimer.

(21) Appl. No.: 14/791,375

(22) Filed: Jul. 3, 2015

(65) Prior Publication Data

US 2015/0351576 A1 Dec. 10, 2015

Related U.S. Application Data

(63) Continuation of application No. 13/902,542, filed on May 24, 2013, now Pat. No. 9,119,497.

(51) Int. Cl.

| | |
|---|---|
| ***A47H 1/142*** | (2006.01) |
| ***A47H 2/00*** | (2006.01) |
| *A47H 23/00* | (2006.01) |

(52) U.S. Cl.

CPC ..... *A47H 1/142* (2013.01); *A47H 2/00* (2013.01); *A47H 2023/003* (2013.01)

(58) Field of Classification Search

CPC ..... A47H 1/142; A47H 1/144; A47H 1/102; A47H 1/16; A47H 1/10; A47H 1/12; A47H 1/122; A47H 1/13; A47H 1/14; A47H 1/00; A47H 1/06; A47H 1/08; A47H 1/04; A47H 2/00; A47H 2023/003

USPC ..... 248/261, 222.11, 220.11, 235, 208, 248/262, 273, 252, 254, 200, 236, 251, 266, 248/267; 211/87.01

See application file for complete search history.

(56) References Cited

U.S. PATENT DOCUMENTS

| | | | | | |
|---|---|---|---|---|---|
| 1,751,062 | A | * | 3/1930 | Wintrob | A47H 1/142 160/126 |
| 3,029,465 | A | * | 4/1962 | Graber | A47H 15/04 16/94 D |
| 3,273,197 | A | * | 9/1966 | Ford | A47H 1/104 16/94 D |
| 3,345,678 | A | * | 10/1967 | Graber | A47H 1/104 16/94 D |
| 3,916,477 | A | * | 11/1975 | Baker, Sr. | A47H 1/144 16/94 D |
| 3,927,437 | A | * | 12/1975 | Ford | A47H 1/144 16/94 R |
| 4,957,255 | A | * | 9/1990 | John | E06B 9/323 160/38 |
| 5,146,648 | A | * | 9/1992 | Hudson | A47H 1/144 16/94 R |

(Continued)

*Primary Examiner* — Nkeisha Smith

(57) ABSTRACT

The present invention relates to a window treatment mounting assembly, and a kit which includes a window treatment mounting assembly and a window treatment or modular fabric components thereof. In one preferred aspect, a window treatment mounting assembly for mounting a window treatment over a window is provided, where the mounting assembly comprises a longitudinally elongated channel beam for releasably retaining the window treatment; a resiliently compressible retention member for releasably coupling the window treatment to the channel beam in a friction fit; and at least one mounting bracket for supporting the channel beam in a mounting position adjacent the window.

14 Claims, 16 Drawing Sheets

(56) References Cited

U.S. PATENT DOCUMENTS 5,451,743 A * 9/1995 du Preez ..... F24D 13/022 219/200
5,555,684 A * 9/1996 Galowitz ..... E06B 1/342 52/204.5
5,667,178 A * 9/1997 Yang ..... E06B 9/323 160/902
6,088,979 A * 7/2000 Neal ..... E06B 3/5418 52/204.54
6,202,967 B1 * 3/2001 Fraczek ..... A47H 23/01 160/166.1
6,336,616 B1 * 1/2002 Lin ..... G03B 21/58 248/222.11
6,470,629 B1 * 10/2002 Haddock ..... E04D 13/10 248/200
6,550,523 B1 * 4/2003 Chen ..... E06B 9/323 160/178.1 R
7,134,469 B2 * 11/2006 Drew ..... E06B 9/56 160/38
7,516,771 B2 * 4/2009 Drew ..... E06B 9/323 160/173 R
7,637,302 B2 * 12/2009 Drew ..... E06B 9/323 160/173 R
2003/0029822 A1 * 2/2003 Fitzsimmons ..... A47H 1/00 211/105.1
2005/0205733 A1 * 9/2005 Nien ..... E06B 9/50 248/261
2008/0023605 A1 * 1/2008 Yang ..... A47B 97/02 248/261
2008/0053035 A1 * 3/2008 Rosenberg ..... E04B 2/7457 52/483.1
2009/0056885 A1 * 3/2009 Garmyn ..... E06B 9/42 160/323.1
2011/0303370 A1 * 12/2011 Dollard ..... E06B 9/262 160/84.01

* cited by examiner

17a

17b

17c

17d

17e

17f

17g

17h

17i

17j

17l

17m

17n

17o

17p

17q

17r

17s

WINDOW TREATMENT MOUNTING ASSEMBLY

RELATED APPLICATIONS

This application claims the benefit of 35 U.S.C. 119(e) to U.S. Provisional Application Ser. No. 61/652,280 filed on May 28, 2012.

SCOPE OF THE INVENTION

The present invention is directed to mounting assemblies for securing decorative window treatments. More particularly, the present invention is directed to a window treatment mounting assembly for installing decorative and easily customizable window treatments, such as valances, curtains, panels and draperies, near or over a window.

BACKGROUND OF THE PRIOR ART

Window treatments are decorative or functional coverings applied to or near a window or window frame. For example, window valances are forms of window treatments that are applied to cover the uppermost part of a window, and can be hung alone or paired with other aesthetics elements including window shades, horizontal or vertical blinds, curtains, drapes, and interior shutters. These window treatments are popular decorative choices amongst home interior designers and consumers for creating aesthetically appealing work pieces to conceal drapery hardware.

Conventionally, customized valances have been attached to 1×3 inch or 1×6 inch wooden beams mounted to a wall directly above the window to be covered. Typically, to install window valances in the conventional manner, two or more L-shaped brackets are secured with screws directly to a wall above the window to be covered. Each L-shaped bracket is positioned approximately four to six feet apart from one another and fixed to a mounting surface on opposing sides of the window, so that the outwardly extending flanges of the L-shaped brackets are level horizontally to support the wooden beam. The wooden beam is attached to each flange of the L-shaped brackets by screws so that the wooden beam is mounted above the window and extends across the window width. A pre-assembled valence material which may include a number of different overlapping fabrics sewn together as a single piece of material is attached at its upper edge to the outer facing upper and/or front surfaces of the wooden beam by velcro, staples or screws as is known in the art so that the valence material covers the wooden beam and hangs down therefrom to cover the upper portion of the window.

The installation and design of conventional window valences is generally limiting since it typically requires the expertise of a seamstress or interior designer to first prepare the pre-sewn valance material to be hung. Furthermore, the wooden beams are not readily and easily detachable from the L-shaped brackets so adjustments cannot be carried out quickly and efficiently once the valance is installed.

SUMMARY OF THE INVENTION

The present invention has been developed in view of the difficulties in the art noted and described above.

One possible non-limiting object of the present invention is to provide an improved window treatment mounting assembly for mounting decorative and easily customizable window treatments, such as valances, curtains, panels and draperies.

Another possible non-limiting object of the present invention is to provide a window treatment mounting assembly which is designed to easily mount to an existing window, the window treatments being composed of pre-fabricated, separate modular fabric components which can be mixed and matched to create a variety of different custom decorative arrangements.

A further possible non-limiting object of the present invention is to provide a window treatment kit which conveniently includes both window treatments and a window treatment mounting assembly for ready installation over pre-installed curtains or with new/additional curtains that can be easily secured to the mounting assembly without requiring further mounting space or modifications to the window.

In view of the disadvantages of existing devices, the present invention provides an improved window treatment mounting assembly intended to allow for the installation of modular fabric components to create custom window treatments, such as valances, curtains and draperies with ease and flexibility.

In one aspect, the present invention provides a window treatment mounting assembly for mounting a window treatment over a window, the mounting assembly comprising: a longitudinally elongated channel beam for releasably retaining the window treatment, the beam comprising a sidewall defining: parallel spaced front and rear beam surfaces; an upwardly open elongate channel between the front and rear beam surfaces; and a bottom beam surface extending from the front beam surface to the rear beam surface, the bottom beam surface defining a downwardly open elongate groove, wherein the bottom beam comprises a rearward engagement member having at least one of a slot and a lip; a resiliently compressible retention member sized for insertion within the channel, whereby engagement between the retention member and at least part of the sidewall releasably couples the window treatment to the channel beam in a friction fit; at least one mounting bracket for supporting the channel beam in a mounting position adjacent the window, each said mounting bracket comprising: an anchor member for securing the mounting bracket in the mounting position; a support arm extending from the anchor member forwardly towards a forward end and defining an upwardly oriented seating surface, the support arm having a rib on the forward end sized for mated engagement in at least part of the elongate groove; and a retention flange projecting forwardly from the anchor member and spaced above the support arm to define a forwardly open channel-recess therebetween; wherein the bottom beam surface is positionable in a mounted arrangement in abutting contact with the seating surface, with the rib in mated engagement with the elongate groove and the engagement member engaging at least one of the retention flange and the channel-recess.

In another aspect, the present invention provides a window treatment mounting assembly for mounting a window treatment, the mounting assembly comprising: an elongate beam for releasably securing the window treatment, the elongate beam comprising a sidewall defining at least: a rear beam surface defining an engagement slot; and a bottom beam surface defining a retaining slot; and at least one mounting bracket for supporting the elongate beam on a mounting surface, each said mounting bracket comprising: a wall flange for securing the bracket to the mounting surface; a first arm extending forwardly from the wall flange, and defining a substantially planar upper seating surface, the first arm having an upwardly extending protrusion on a forward end sized to be received in the retaining slot; and a second arm projecting forwardly from the wall flange and spaced above the first arm to define a forwardly open channel therebetween, the second arm being sized for insertion in the engagement slot; wherein the bottom beam surface is positionable in a mounted arrangement on the seating surface, with the second arm inserted in the engagement slot and the protrusion received in the retaining slot, whereby the beam is transversely slidable relative to the at least one mounting bracket in the mounted arrangement.

In a further aspect, the present invention provides a window treatment mounting assembly for mounting a window treatment over a window, the mounting assembly comprising: a curtain rod for hanging draperies or curtains (hereinafter collectively curtains) over a window surface; a longitudinally elongated beam for releasably retaining the window treatment, the beam comprising a sidewall having a rearward engagement member, the sidewall defining an upwardly open elongate channel and a downwardly open groove positioned forwardly of the engagement member; a resiliently compressible retention member sized for insertion within the channel, whereby engagement between the retention member and at least part of the sidewall releasably couples the window treatment to the channel beam in a friction fit; a plurality of mounting bracket positionable on a mounting surface in a longitudinally spaced relationship relative to one another to support the beam over the window, each said mounting bracket comprising: an anchor member for securing the mounting bracket to the mounting surface; a support arm projecting forwardly from the anchor member towards a forward end and defining an upper seating surface, the support arm having a rib on the forward end sized for mated engagement in the groove and a removable curtain rod mounting member for releasably mounting the curtain rod thereon; and a retention flange coupled to the support arm and offset forwardly from the anchor member, the retention flange being substantially parallel to and spaced above the support arm to define a forwardly open channel therebetween; wherein the bottom beam surface is positionable in a mounted arrangement in contact with the seating surface, with the rib in mated engagement with the elongate groove and the engagement member engaging at least one of the retention flange and the forwardly open channel.

In yet a further aspect, the present invention provides a kit comprising a window treatment and the window treatment assembly of the current invention.

The window treatment preferably comprises a plurality of modular fabric components positionable in the upwardly open elongated channel.

Preferably, the rib is positionable in the elongate groove under pivotal movement of the channel beam with the engagement member engaging at least one of the retention flange and the channel-recess.

The engagement member preferably comprises a transverse slot for transversely sliding engagement with the retention flange and the channel-recess or forwardly open channel.

Preferably, the channel beam further comprises a pair of longitudinally opposed end walls, each said end wall comprising a hook-and-loop fastener for releasably securing a window treatment end piece.

Preferably, the anchor member comprises a flange, hook-and-loop fastener, adhesive or fastening bolt, and most preferably, a wall attachment flange oriented substantially normal to the support arm, the wall attachment flange defining at least one hole for receiving a mechanical fastener therein.

In one embodiment, the retention flange or second arm is offset forwardly from the wall attachment flange. Alternatively, the retention flange or second arm is coupled to the wall attachment flange, and wherein when the bottom beam surface is in the mounted arrangement, the rear beam surface is in abutting contact with the wall attachment flange.

Preferably, the mounting assembly comprises a plurality of said mounting brackets positionable in a longitudinally spaced relationship relative to one another.

In one embodiment, the mounting assembly further comprises at least one hook hanger, wherein the support or first arm further defines a lower surface opposed to the seating surface for releasably attaching an associated one of said hook hangers thereto. Preferably, the mounting assembly further comprises a curtain rod for securing a curtain to the mounting assembly, the curtain rod being releasably mountable on the at least one hook hanger. The curtain rod preferably comprises a pair of end caps.

Preferably, the hook hanger comprises an upper flange portion for coupling with the lower surface of the support arm. The lower surface preferably comprises a hanger holder for receiving the upper flange portion of an associated hook hanger, or a flexible loop for receiving the curtain rod therethrough.

Preferably, the elongate channel, the elongate groove and the rearward engagement member are integrally formed as an extrusion. The extrusion most preferably comprises an extruded metal or plastic, the metal preferably being aluminum.

In one embodiment, the engagement member comprises either a slot defined on a middle or upper portion of the rear beam surface, or a lip sized to be received in the channel-recess or forwardly open channel.

Preferably, the elongate beam comprises at least one of hook-and-loop fastener, clamp or clamping arm for attaching the window treatment thereto.

Further aspects of the invention will become apparent upon reading the following detailed description and drawings which illustrates exemplary embodiments of this invention, and which is in no way intended to limit the scope of the present invention.

BRIEF DESCRIPTION OF THE DRAWINGS

Reference may now be had to the following detailed description taken together with the accompanying drawings in which.

DETAILED DESCRIPTION OF THE PREFERRED EMBODIMENTS

Figure 1:
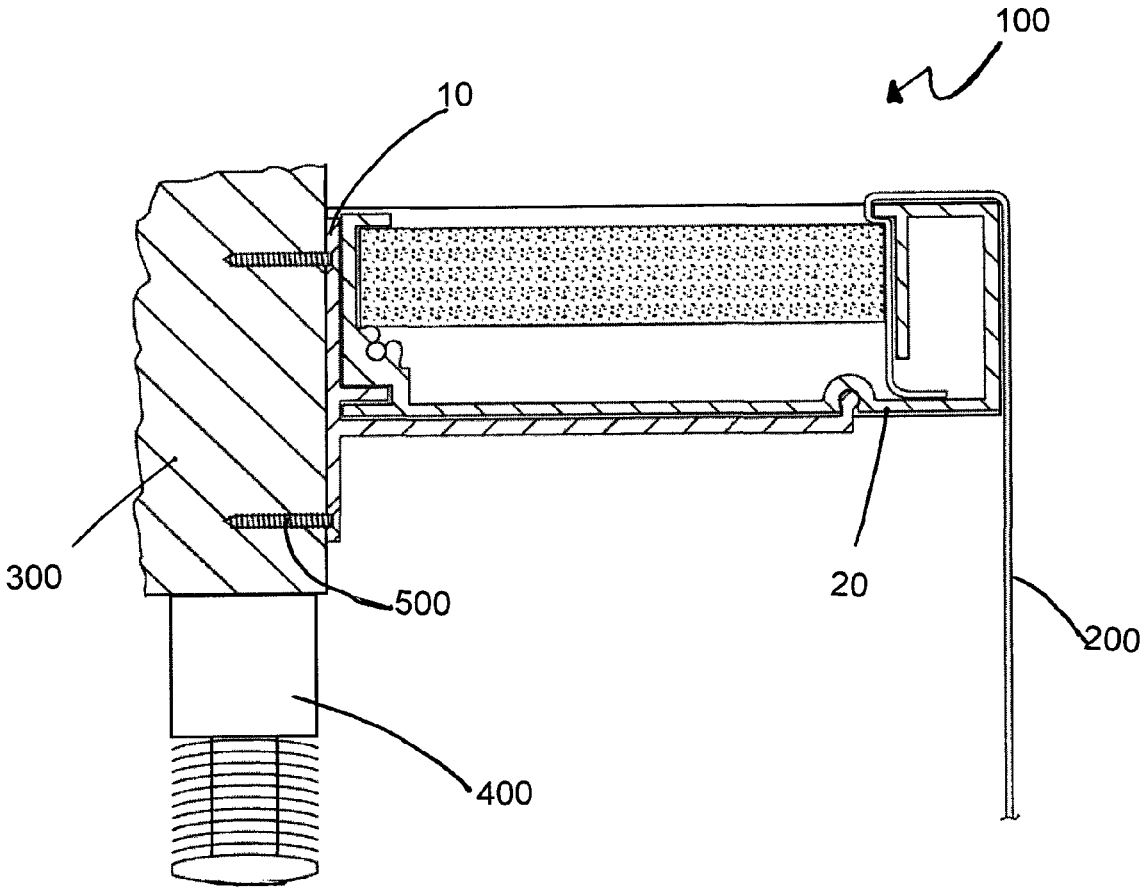
FIG. 1 shows a side cross-sectional view of a window treatment mounting assembly in accordance with a first embodiment of the present invention.

Reference may now be had to FIG. 1 which shows a cross-sectional view of a window treatment mounting assembly 100 in accordance with a first embodiment of the present invention.

The mounting assembly 100 preferably includes at least two mounting brackets 10 (only one shown in FIG. 1 and two shown in FIG. 4); a longitudinally elongated channel beam 20; a window treatment valence 200. In FIG. 1, the mounting assembly 100 is shown in a fully assembled form with the mounting brackets 10 secured to the mounting surface 300 with a pair of screws 500 over a window blind 400.

Figure 2:
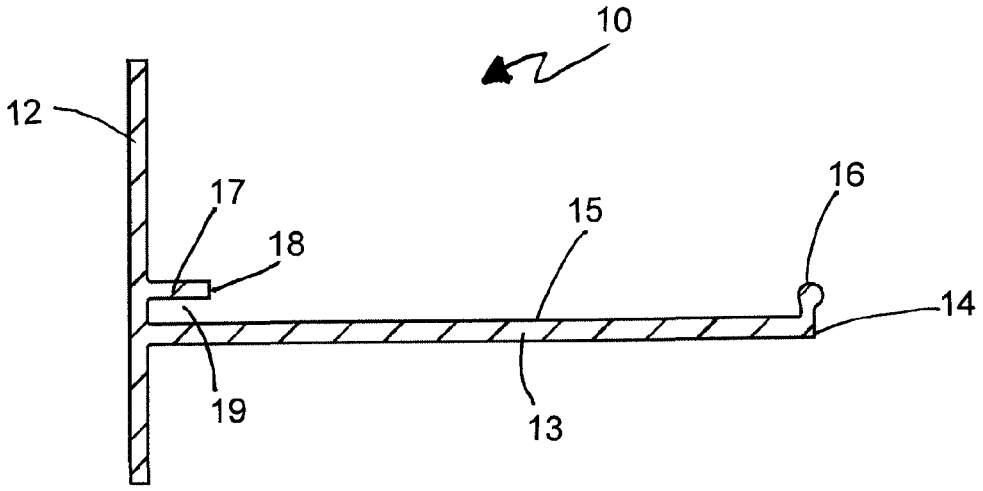
FIG. 2 shows a side cross-sectional view of the mounting bracket of the mounting assembly shown in FIG. 1.
Figure 4:
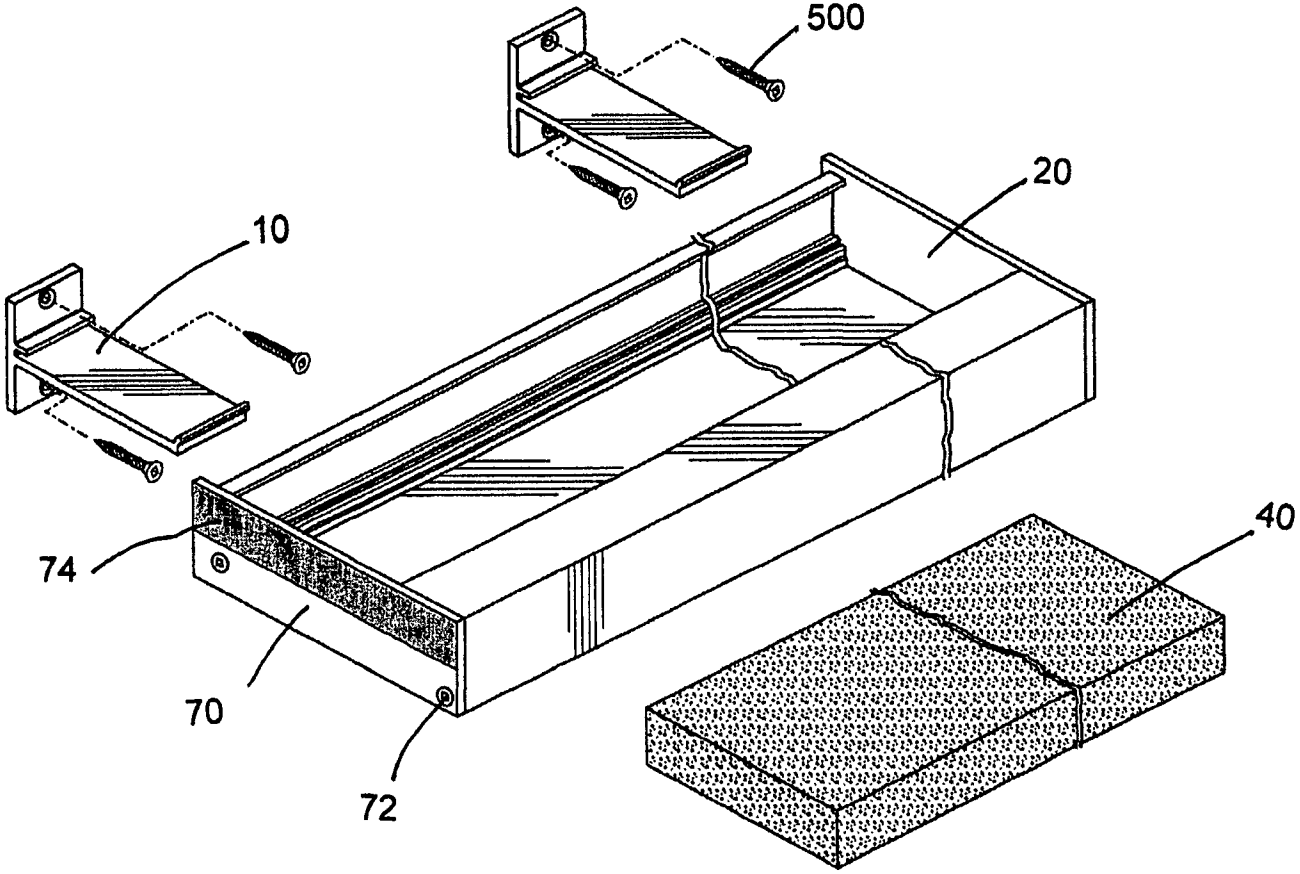
FIG. 4 shows a partially exploded perspective view of the mounting assembly shown in FIG. 1 in a disassembled form.

As shown in FIG. 2, the mounting bracket 10 includes a wall attachment flange 12 having a rearward facing surface configured to be in contact against the mounting surface when the bracket 10 is fixed to the mounting surface. As best shown in FIG. 4, the flange 12 is provided with upper and lower portions each with a through hole so that a screw or the like can attach the bracket 10 directly and securely to the mounting surface, such as a portion of a wall or window frame above the window to be dressed with the valence 200.

A support arm 13 extends substantially normal to and forwardly from the flange 12 a distance of between about 5 cm to about 20 cm to a forward end 14, and defines a generally planar upper seating surface 15. Provided on the forward end 14 is a rib 16 protruding upwardly in the shape of a longitudinally elongated cylindrical boss as best shown in FIG. 4. Also extending forwardly from the flange 12 is a retention flange 17 in a plane parallel to and spaced above the support arm 13 to a forward end 18. The forward end 18 of the retention flange 17 extends a distance of between about 0.1 cm to about 1 cm, so as to terminate closer towards the wall attachment flange 12 than the forward end 14 of the support arm 13. A bottom surface of the retention flange 17 and an upper portion of the seating surface 15 of the support arm 13 define a forwardly open slot or channel-recess 19.

Figure 3:
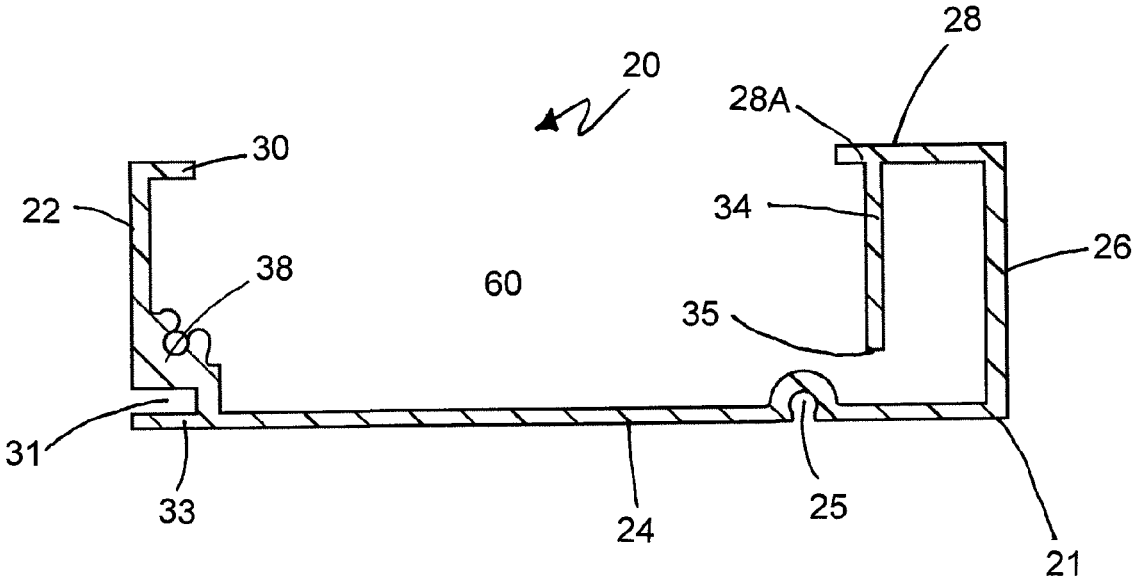
FIG. 3 shows a side cross-sectional view of the longitudinally elongated channel beam of the mounting assembly shown in FIG. 1.

Reference may now be had to FIG. 3 which illustrates a cross-sectional view of the longitudinally elongated channel beam 20 in accordance with a preferred embodiment of the present invention. The channel beam 20 includes an integrally formed sidewall 21 formed as a generally upwardly open square C-shape having an open interior defined by a rear beam surface 22, a bottom beam surface 24, a front beam surface 26 and a top front beam surface 28.

The rear beam surface 22 extends from a top forwardly projecting lip portion 30 to a bottom lip portion 38 which are arranged to support, position or retain in place a resiliently compressible retention member 40. The top and bottom lip portions 30, 38 are spaced between about 0.5 cm and about 10 cm. The rear beam surface 22 partially defines along a lowermost portion a longitudinally extending rearwardly open slot 31 sized to receive the retention flange 17 of the mounting bracket 10. The bottom side of the slot 31 is defined by a rear lip 33 which is generally coplanar and integral with the bottom beam surface 24, and which is sized for insertion within the channel-recess 19 of the bracket 10. The bottom beam surface 24 extends a distance of between about 7 cm and about 25 cm in a generally perpendicular orientation from the rear beam surface 22 to merge with the front beam surface 26. The bottom beam surface 24 defines a longitudinally extending groove 25 spaced forward from the rearmost end of the lip 33 at a distance which is substantially equal to the distance between the wall attachment flange 12 and rib 16 of the mounting bracket 10. The groove 25 has a size selected for receiving and retaining therein the rib 16 of the bracket 10.

The front beam surface 26 of the channel beam extends in a substantially perpendicular orientation from a forward end of the bottom beam surface 24 to a forward end of the top front beam surface 28. The bottom and top front beam surfaces 24, 28 are distanced from about 1 cm to about 12 cm. The top front beam surface 28 projects rearwardly from and substantially normal to the uppermost end of the front beam surface 26 towards the rear beam surface 22. A retention wall 34 projects downwardly from the top front beam surface 28 from a position proximal to a rearmost end of the top front beam surface 28 to a downward end 35, so as to define a retaining end portion **28*a* projecting rearwardly from the wall 34. The retention wall 34 is spaced from the front beam surface 24 from about 0.5 cm to about 10 cm. The sidewall 21 of the channel beam 20 thereby defines an upwardly open C-shape which extends longitudinally to form a longitudinally elongated channel 60, and which is sized to receive the retention member 40** in a compressible friction fit.

Figure 5:
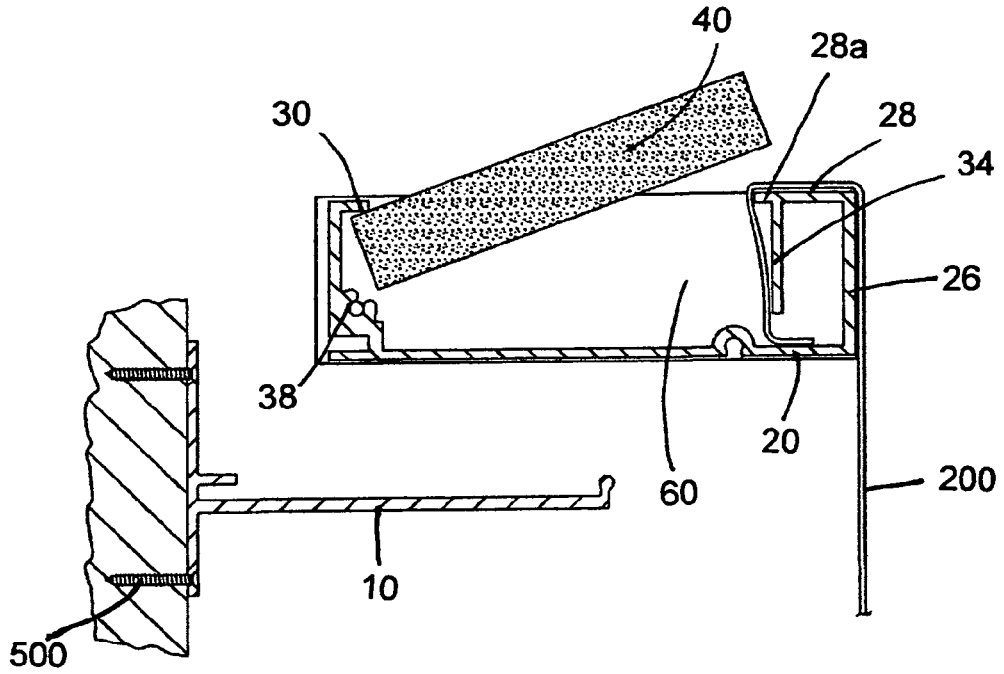
FIG. 5 shows a side cross-sectional view illustrating insertion of the resiliently compressible retention member of the mounting assembly shown in FIG. 1.
Figure 6:
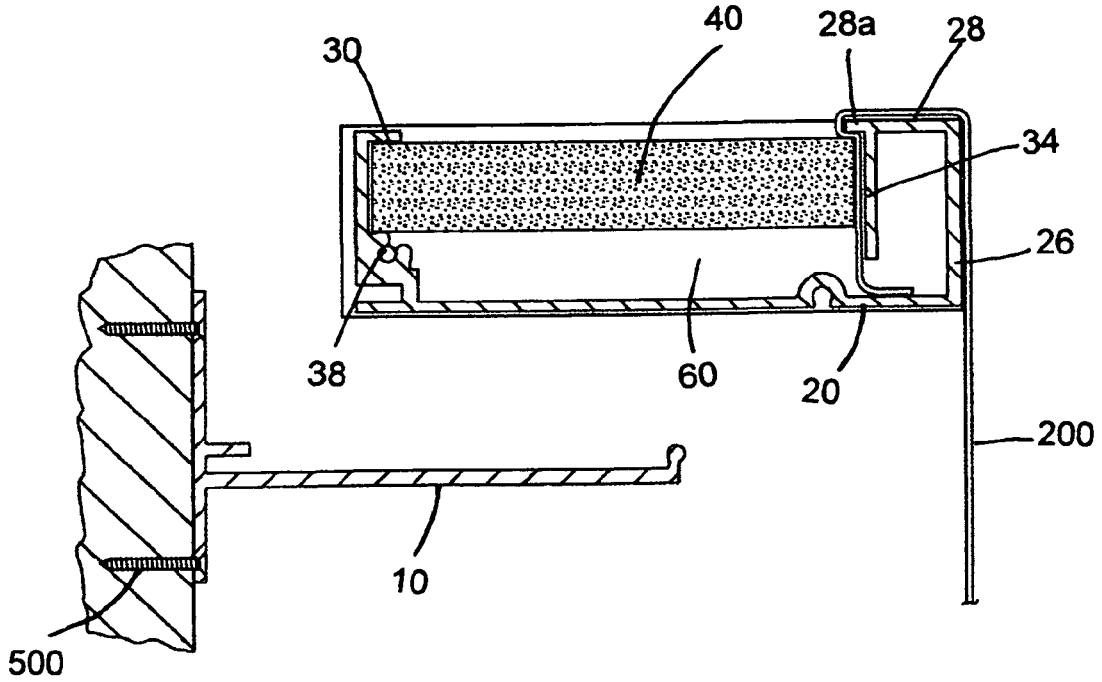
FIG. 6 shows a side cross-sectional view illustrating the retention member fully inserted into the channel beam of the mounting assembly shown in FIG. 1.

Reference may now be had to FIGS. 5 and 6 which together illustrate insertion of the retention member 40 into the channel beam 20. For proper insertion and retention in the channel beam 20, the retention wall 34 and retaining end portion **28*a* on a forward end, together with the bottom and top lip portions 30, 38 on a rear end provide guiding surfaces to facilitate insertion, positioning and frictional engagement of the retention member 40 in the elongated channel 60. In operation, to secure the window treatment valance 200 with insertion of the retention member 40, an uppermost portion of the valence 200 is first draped over and around the front beam surface 26 and top front beam surface 28, such that the uppermost portion is placed in the elongated channel 60 near the retention wall 34 as best shown in FIG. 5. The retention member 40 is thereafter compressed to reduce its outer size, and positioned/inserted into the elongated channel 60 with the valence 200 positioned forwardly of the retention member 40. The outwardly expanding resilience of the retention member 40 within the elongated channel 60 provides a clamping force to clamp the uppermost portion of the valance 200 placed between the member 40 and wall 34 as shown in FIG. 6**.

For more complete valence coverage, and to prevent the retention member 40 and valence 200 from falling off, the channel beam 20 further includes a pair of longitudinally opposed end wall portions 70 as shown in FIG. 4 (only one shown). The end wall portions 70 are secured on the lateral ends of the sidewall 21 with a plurality of screws 72, before or after the retention member 40 and valence 200 are coupled to the channel beam 20. Attached to outer and/or upper surfaces of the end wall portion 70 is a hook-and-loop fastener 74 for attaching valence end pieces thereto (the fastener 74 shown only on the outer surface in FIG. 4). Alternatively, the valence end pieces may be coupled to the channel beam 20 by engagement between the lateral ends of the retention member 40 and the inner surface of the end wall portion 70 in a friction fit, and may further be reinforced with the hook-and-loop fastener 74.

Figure 7:
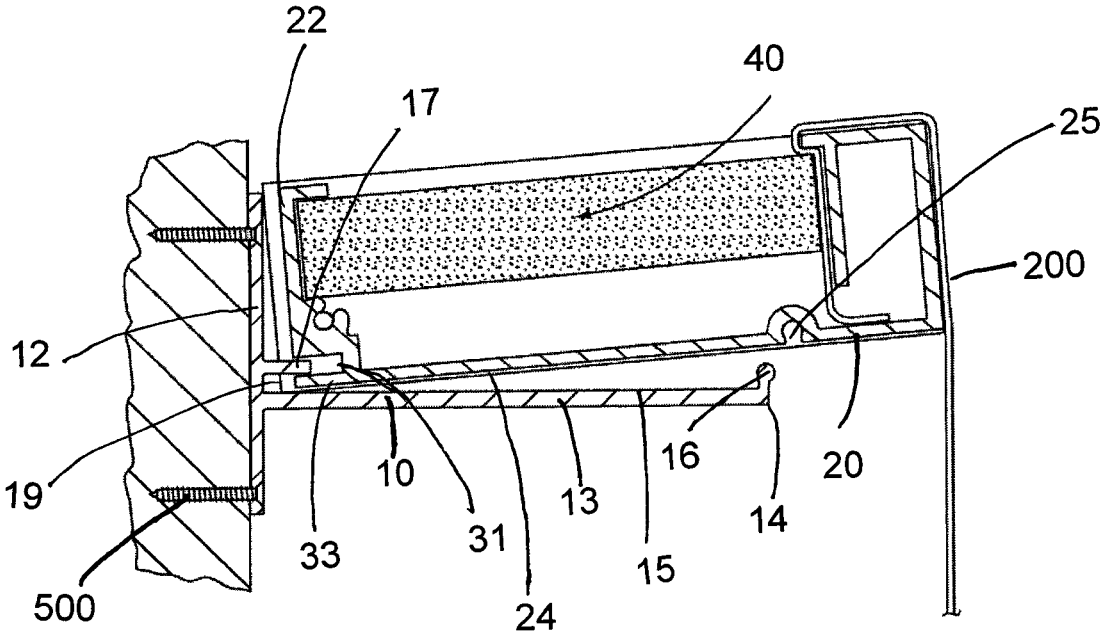
FIG. 7 shows a side cross-sectional view of the channel beam being mounted onto the bracket of the mounting assembly shown in FIG. 1.

Reference may now be had to FIG. 7 which illustrates positioning and coupling of the channel beam 20 to the mounting brackets 10. In operation, the rear beam surface 22 of the channel beam 20 is brought into contact with the wall attachment flange 12, with the rear lip 33 inserted into the channel-recess 19 concurrently with the retention flange 17 received in the slot 31. The channel beam 20 is thereafter pivoted from a bottom-rear portion downwardly towards the forward end 14 of the bracket 10 to receive and retain the rib 16 in the groove 25 in a ball-and-socket joint or snap-fit relationship. Once the rib 16 is received in the groove 25, the seating surface 15 of the support arm 13 abuts the bottom beam surface 24, such that the channel beam 20 is securely seated and supported on the brackets 10 as best shown in FIG. 1.

It is possible to reposition the mounted channel beam 20 by detaching the channel beam 20 from the brackets 10, and mounting it again at a new desired position. Alternatively, the channel beam 20 may be repositioned in the mounted position with sliding movement of the channel beam 20 relative to the brackets 10.

Figure 8:
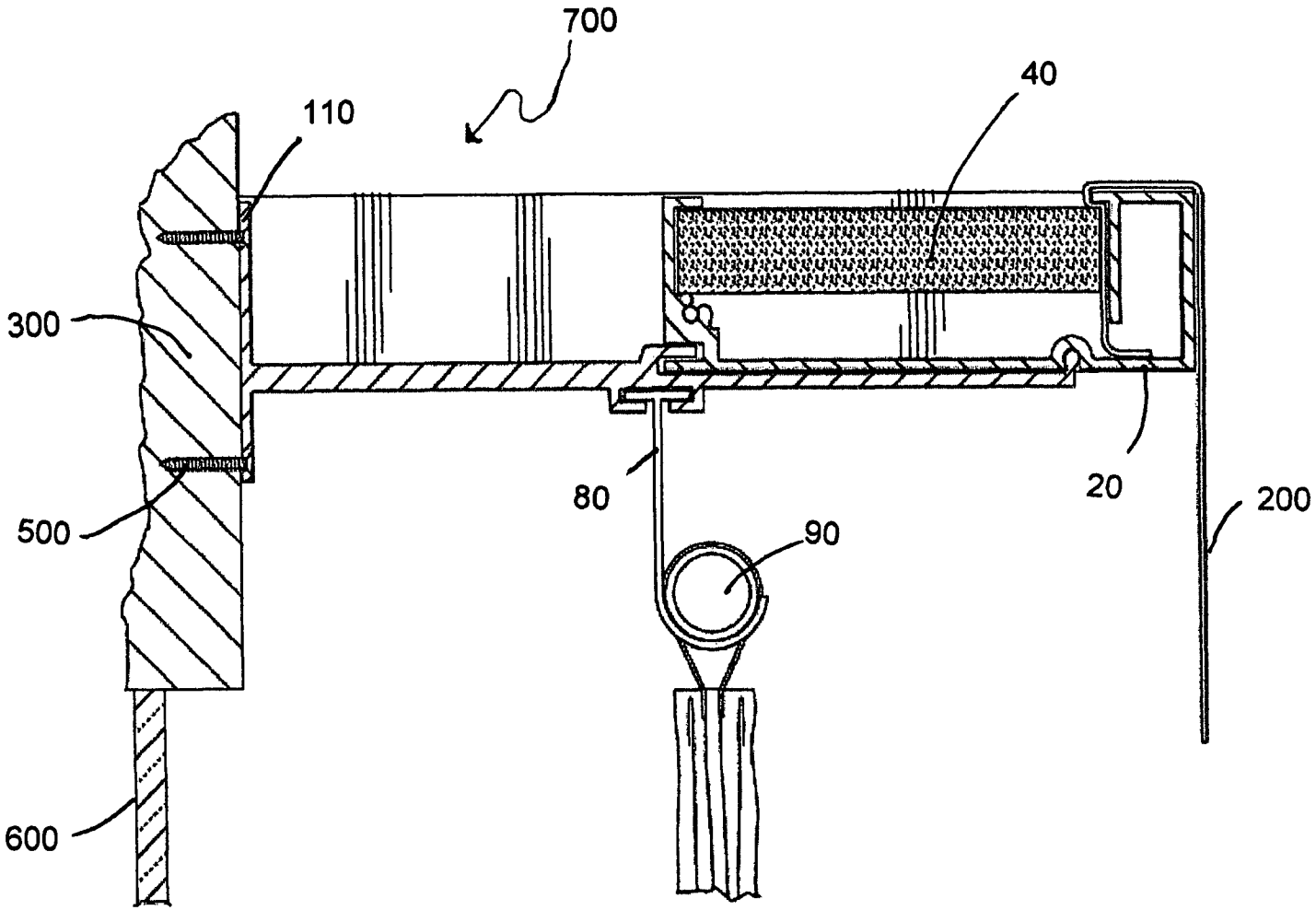
FIG. 8 shows a side cross-sectional view of an extended or offset window treatment mounting assembly with an attached hook hanger and a curtain rod in accordance with a second embodiment of the present invention.

Reference may now be had to FIG. 8 which shows a cross-sectional view of an extended or offset window treatment mounting assembly 700 in accordance with a second embodiment of the present invention. The same reference numerals will be used to illustrate like elements, with the differences being more fully explained below.

The mounting assembly 700 includes at least two offset mounting brackets 110 (only one shown); a longitudinally elongated channel beam 20; and a window treatment valance 200. As in FIG. 1, the mounting assembly 700 is shown in a preferred fully assembled form with the mounting brackets 110 secured to the mounting surface 300 with a pair of screws 500 over a window 600.

Figure 9:
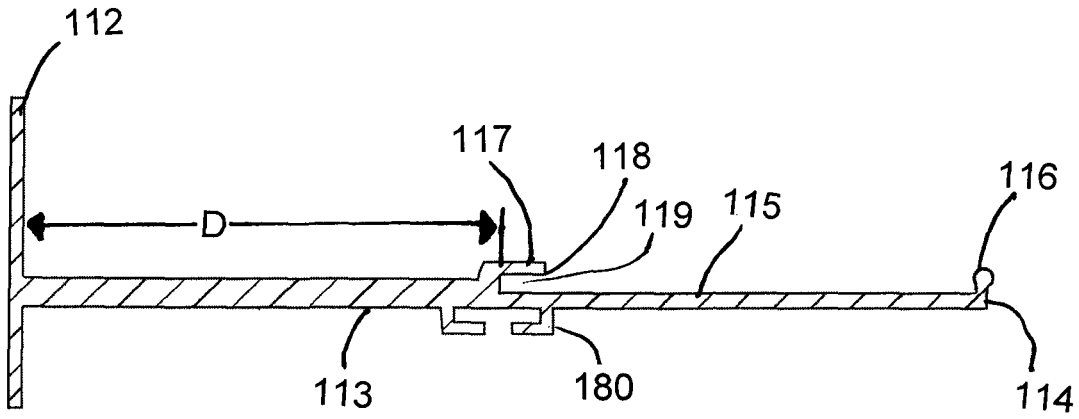
FIG. 9 shows a side cross-sectional view of the extended wall mounting bracket of the mounting assembly shown in FIG. 8.
Figure 11:
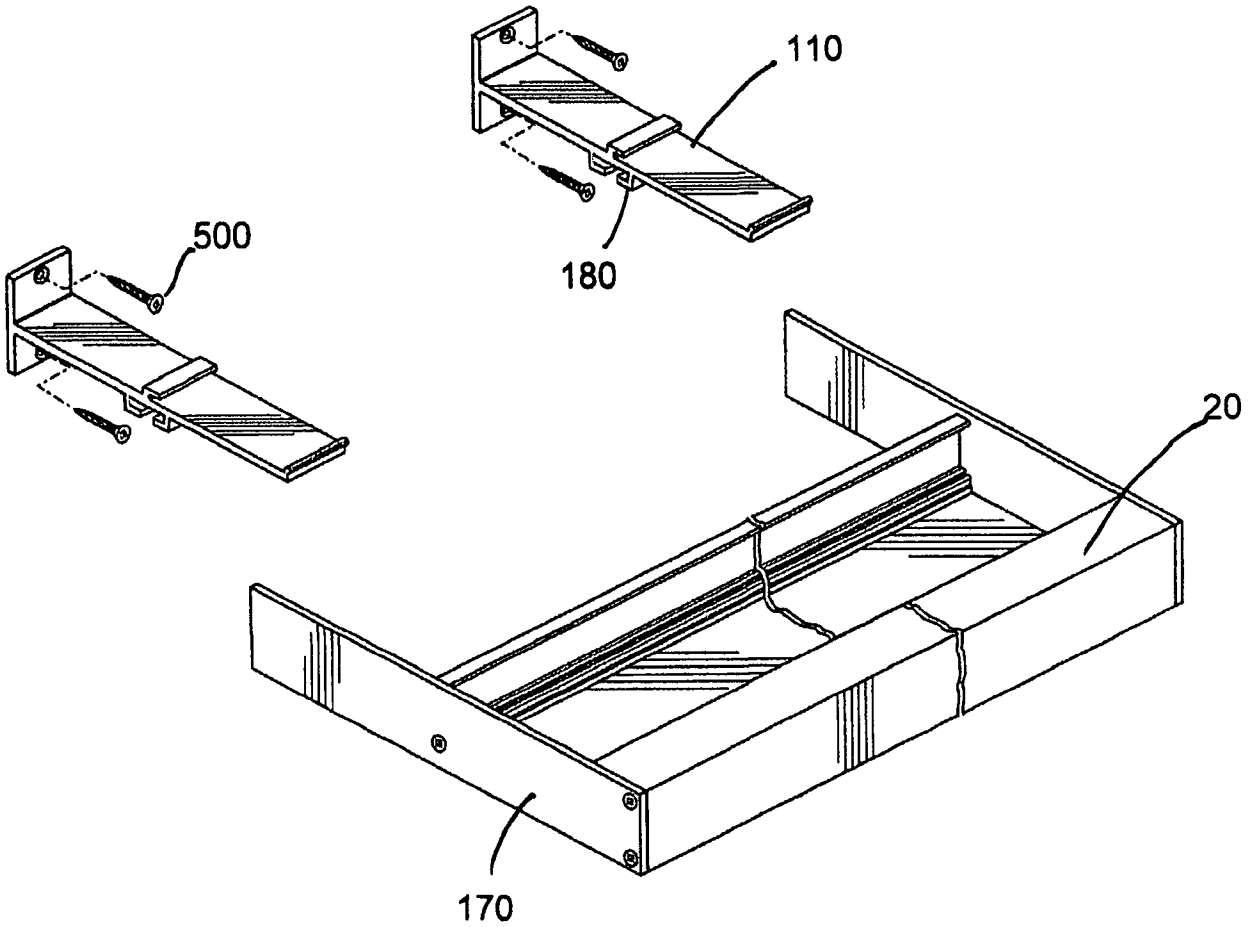
FIG. 11 shows a partially exploded perspective view of the extended brackets without hook hangers and the longitudinally elongated channel beam of the mounting assembly shown in FIG. 8.
Figure 12:
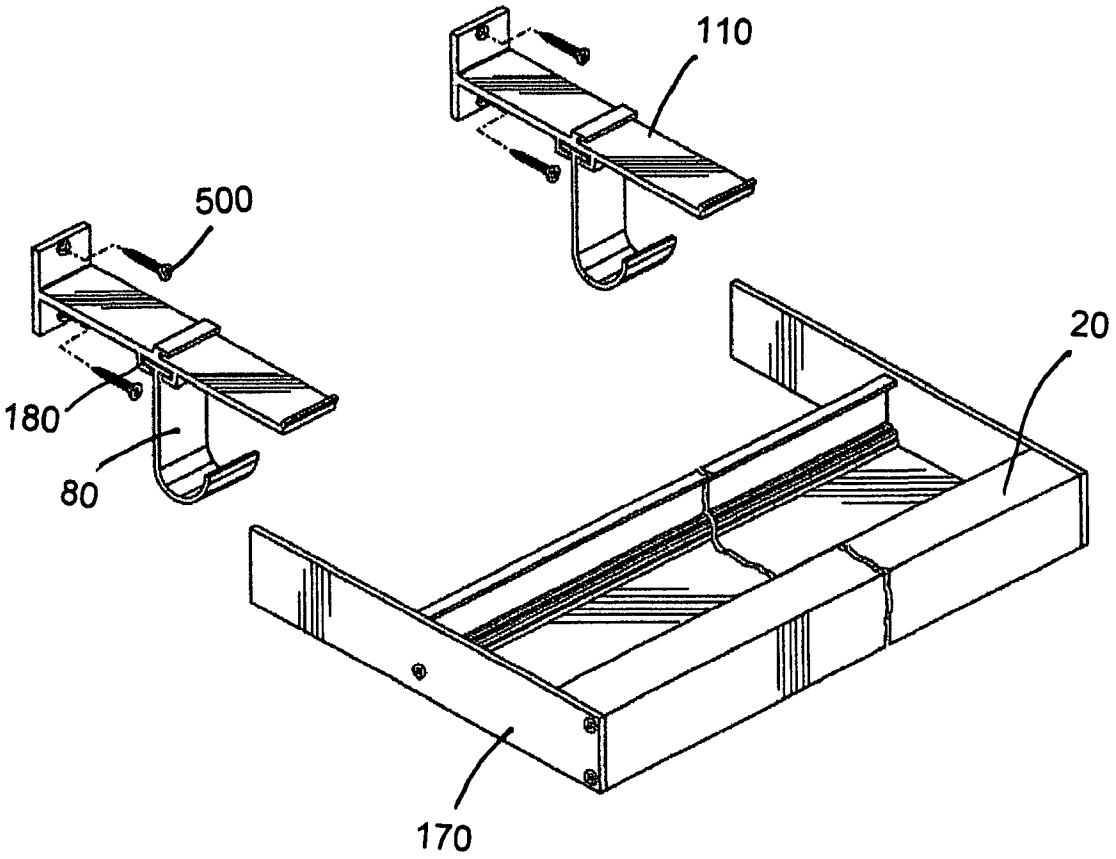
FIG. 12 shows a partially exploded perspective view of the extended brackets with associated hook hangers and the channel beam of the mounting assembly shown in FIG. 8.

As shown in FIG. 9, the offset bracket 110 includes a wall attachment flange 112 having a rearward facing abutting surface configured to abut against the mounting surface when the offset bracket 110 is secured to the mounting surface. A support arm 113 extends substantially normal to and forwardly from the flange 112 a distance of about 8 cm to about 30 cm to a forward end 114, and defines a generally planar upper seating surface 115. The forward end 114 is provided with a rib 116 protruding upwardly in the shape of a longitudinally elongated cylindrical boss as best shown in FIGS. 11 and 12. A retention flange 117 is integrally formed with the support arm 113 on its upper surface in a position offset from the flange 112 at a distance of about 2 cm to 25 cm. The retention flange 117 extends forwardly a distance of between about 0.1 cm to about 1 cm along a plane parallel to and spaced above the support arm 113 to a forward end 118, so as to terminate closer towards the wall attachment flange 112 than the forward end 114 of the support arm 113. The retention flange 117 is sized to be received in the slot 31 of the channel beam 20. A bottom surface of the retention flange 117 and an upper portion of the seating surface 115 defines a forwardly open channel-recess 119 sized to receive the rear lip 33 of the channel beam 20.

Figure 10:
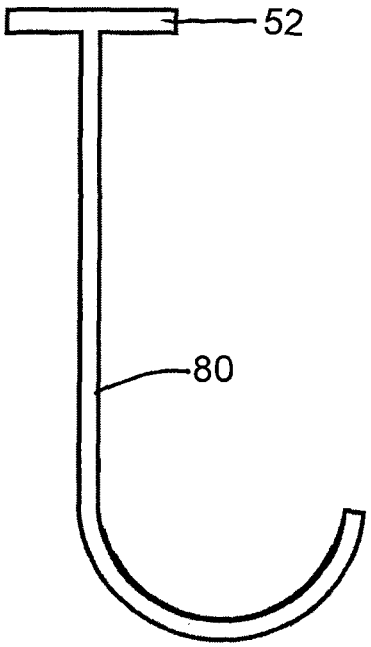
FIG. 10 shows a side cross-sectional view of the hook hanger of the mounting assembly shown in FIG. 8.

The offset bracket 110 includes a hanger holder 180 which extends downwardly from a lower surface of the support arm 114 to slidingly and removably receive an upper flange 52 of a hook hanger 80 shown in FIG. 10. Each offset bracket 110 may be provided without an associated hook hanger 80 coupled thereto as shown in FIG. 11, or with the hook hanger 80 as shown in FIG. 12.

Figure 13:
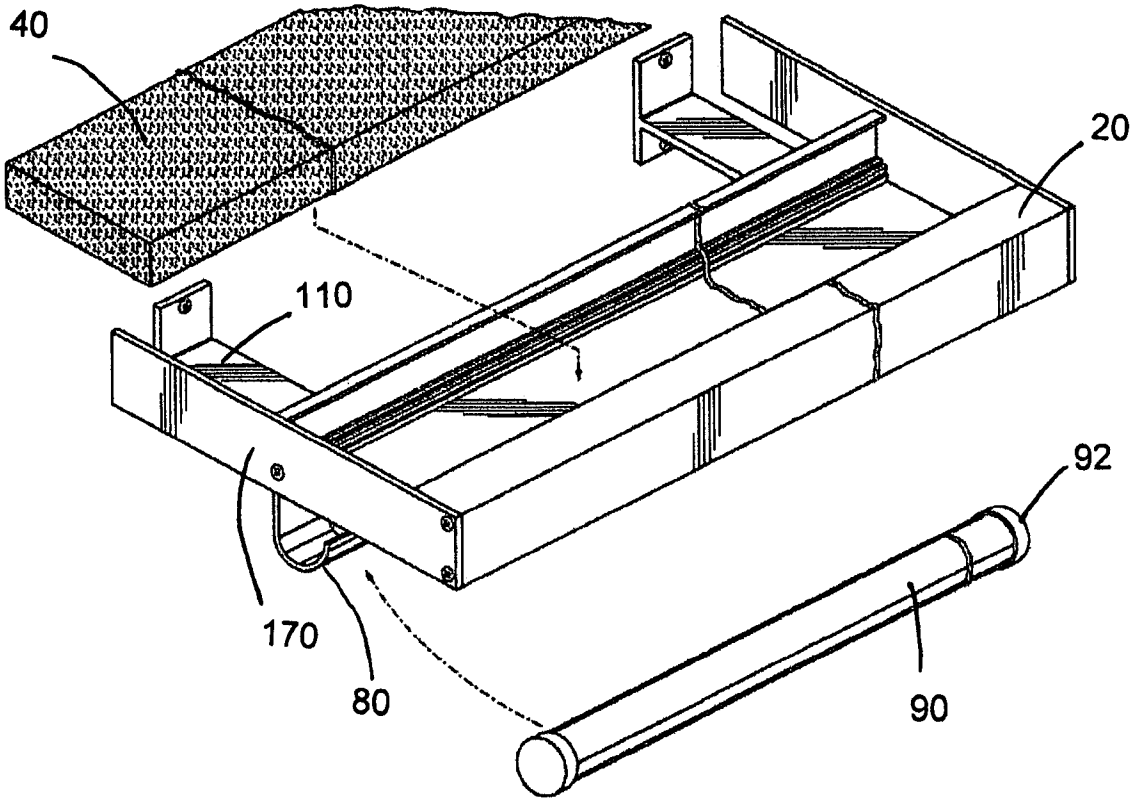
FIG. 13 shows a partially exploded perspective view of the channel beam mounted on the extended brackets, and which illustrates direction of insertion for the retention member and the curtain rod of the mounting assembly shown in FIG. 8.
Figure 14:
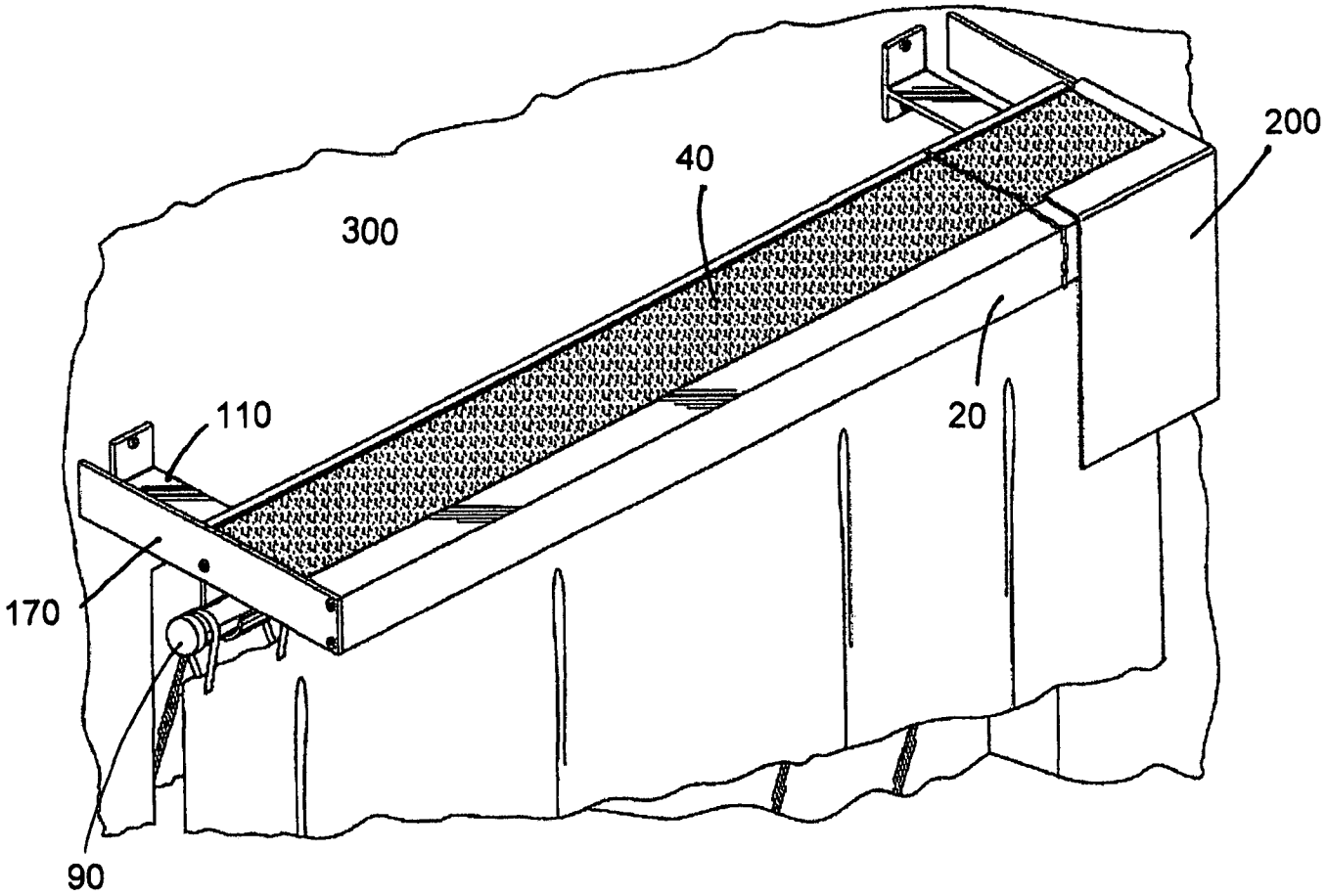
FIG. 14 shows a partial cutaway perspective view of a fully assembled form of the mounting assembly shown in FIG. 8 with a window treatment and a curtain installed thereon.

In operation, the valence 200 may be coupled to the channel beam 20, and the channel beam 20 to the offset brackets 110 in manners similar to those described above in respect of the window treatment mounting assembly 100 with a few notable differences. Most importantly, as the retention flange 117 is offset forwardly from the wall attachment flange 112, the rear beam surface 22 of the channel beam 20 do not contact the wall attachment flange 112 when mounted on the offset brackets 110. Rather, the channel beam 20 could be mounted at a pre-selected distance D from the wall attachment flange 112 as illustrated in FIG. 9. Furthermore, if the offset brackets 110 are provided with associated hook hangers 80 shown in FIG. 12, a curtain rod 90 may be mounted longitudinally on a hook portion of the hook hangers 80 as illustrated in FIG. 13. The curtain rod 90 supports hanging curtains, draperies, panels and the like as shown in FIG. 14. The curtain rod 90 is preferably provided with end caps 92 to prevent the drapery or curtain from sliding off the ends thereof as shown in FIG. 13. The end caps 92 are preferably configured to longitudinally abut against the outermost positioned hook hangers 80 for more secure and non-slidable mounting of the curtain rod 90 to the channel beam 20.

To provide for complete lateral valence coverage and at the same time prevent the retention member 40 and valence from falling off, the channel beam 20 is provided with a pair of longitudinally opposed extended end wall portions 170 as shown in FIGS. 11 to 14. The extended end wall portions 170 are similar to the end wall portions 70, with the exception that the portions 170 extend further rearwardly past the rear beam surface 22 of the channel beam 20 to substantially cover the extended length of the offset bracket 110. The outer and/or upper surfaces of the portions 170 are preferably covered with a hook-and-loop fastener (not shown) for coupling extended valence end pieces thereto. Alternatively, the extended valence end pieces or an overhanging portion of the valence 200 may be secured by frictional engagement between a longitudinal end of the retention member 40 and the inner surface of the portion 170 as shown in FIG. 14.

Figure 15:
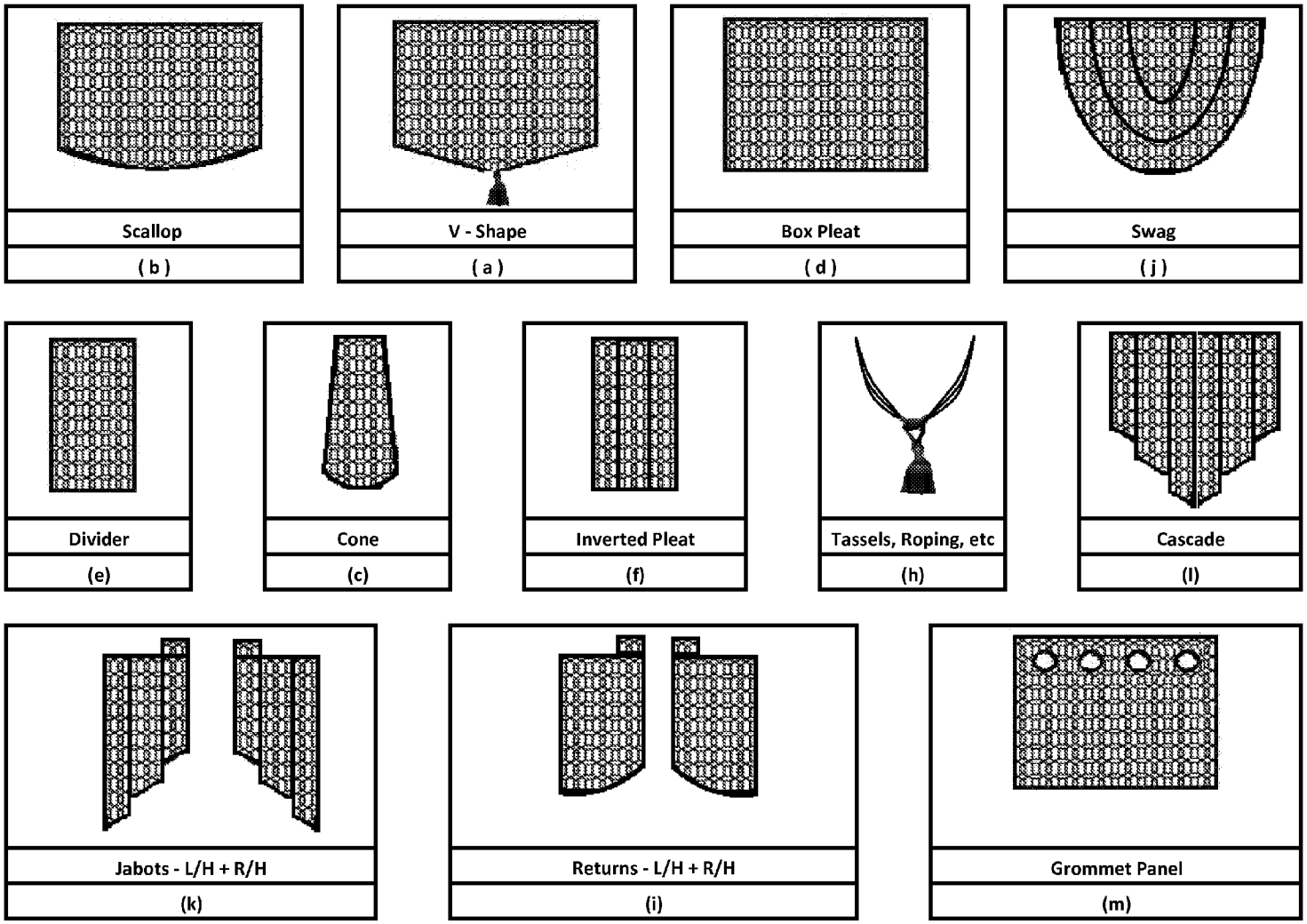
FIG. 15 shows illustrative embodiments of preferred fabric components which may be assembled to create a custom valance for mounting to a window with the mounting assembly of the present invention.

The mounting assembly of the present invention allows use with a plurality of pre-fabricated standardized modular fabric components and/or design accessories. FIG. 15 shows a number of preferred non-limiting pre-fabricated modular fabric components and designs, including (a) V-shape panel; (b) scallop panel; (c) cone panel; (d) box pleat panel; (e) divider panel; (f) inverted pleat panel; (h) tassels, roping, etc.; (i) return (left/right) panels; (j) swag panel; (k) jabots (left/right) panels; (l) cascade panel; and (m) grommet panel. Other modular fabric components, designs and pieces may be utilized or included in the window treatment kit of the present invention.

Figure 16:
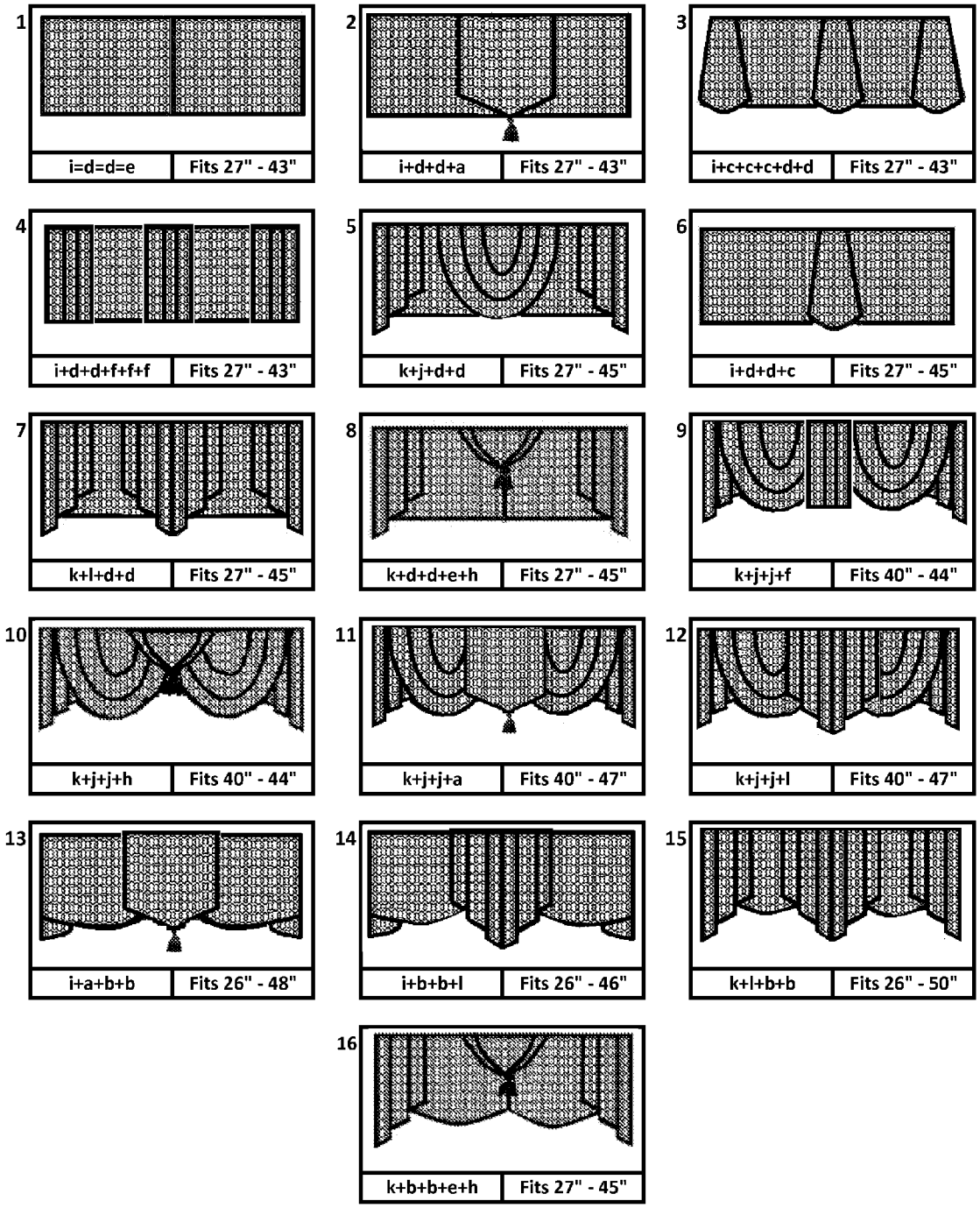
FIG. 16 shows front elevation views of various window treatment configurations produced from modular fabric components for use with the mounting assembly of the present invention.

Separate modular fabric components may be provided in a customizable combination in a kit to be arranged or layered to create a number of different possible window treatment designs. Each modular fabric components may have different shapes and sizes, or be made from different materials or of different colours as may be desired. The channel beam 20 permits securing of separate modular fabric components without the need to first sew the fabric components together to provide a single piece. Possible, non-limiting modular component designs which may be arranged and secured to the channel beam 20 for placement over windows of varying longitudinal width are shown in FIG. 16.

Figure 17:
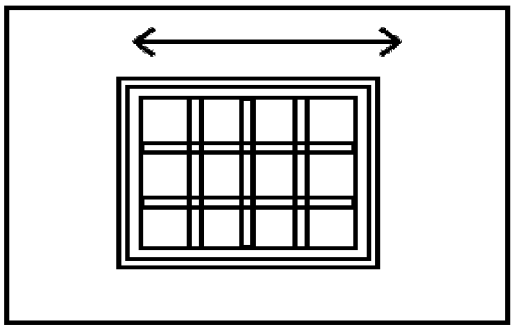
FIG. 17 shows a series of photographs illustrating a process of assembling and mounting modular fabric components to the mounting assembly of FIG. 8 to create a custom valence.
Figure 17:
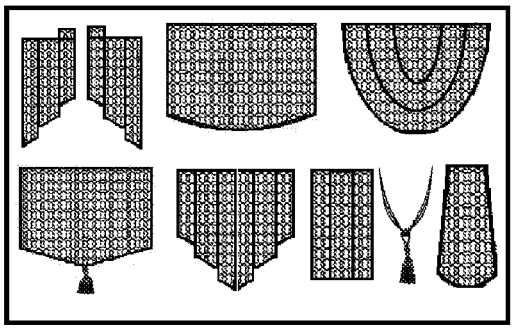
Figure 17:
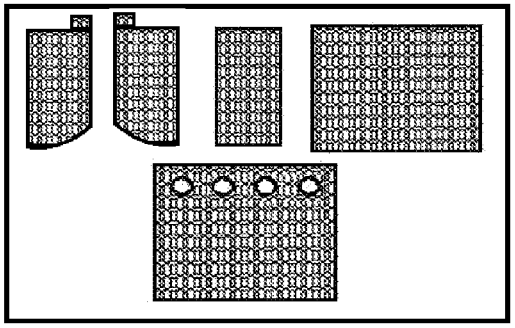
Figure 17:
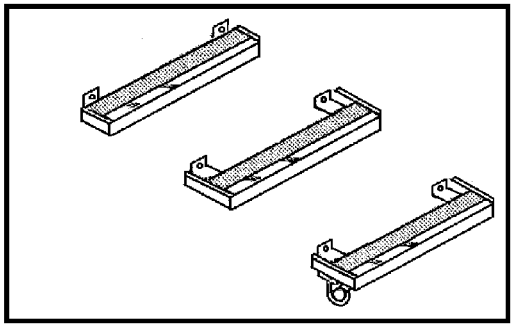
Figure 17:
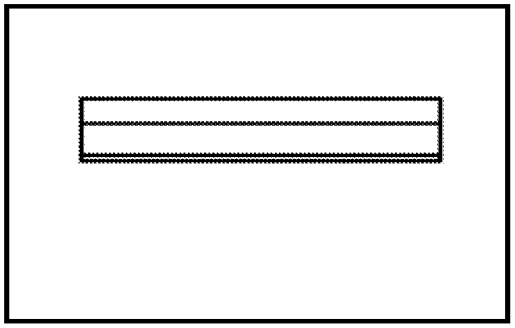
Figure 17:
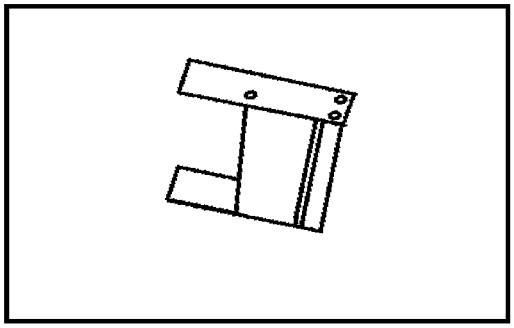
Figure 17:
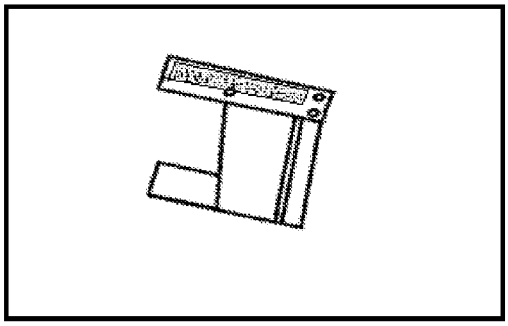
Figure 17:
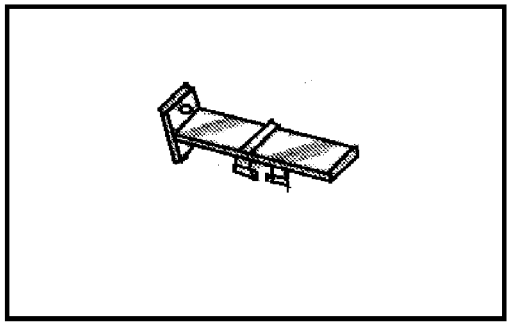
Figure 17:
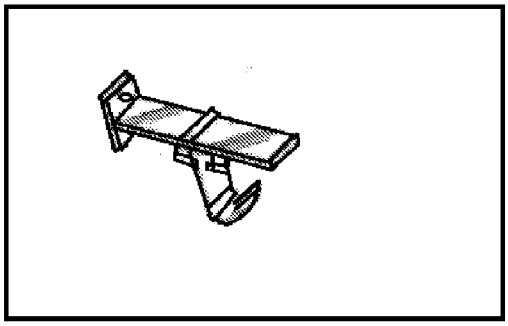
Figure 17:
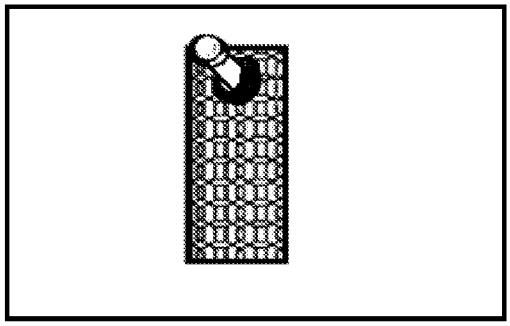
Figure 17:
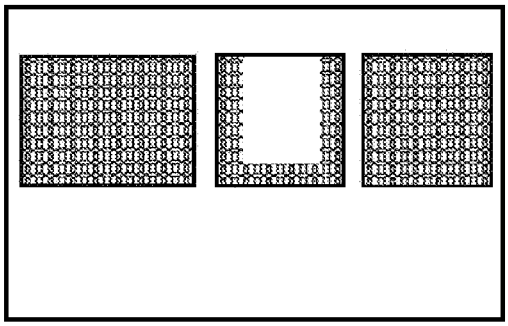
Figure 17:
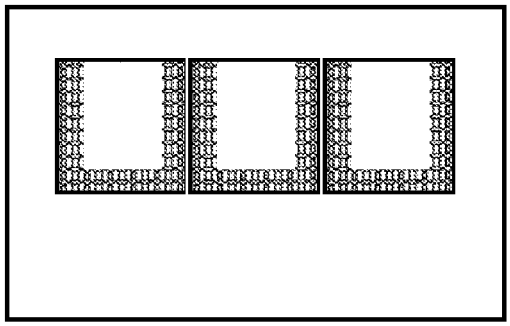
Figure 17:
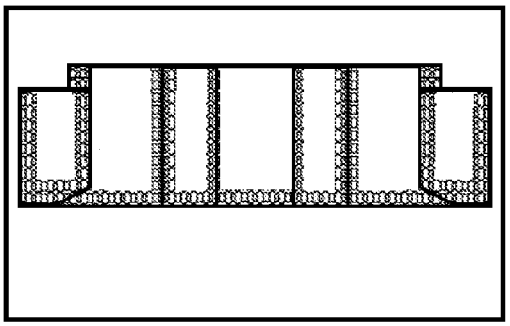
Figure 17:
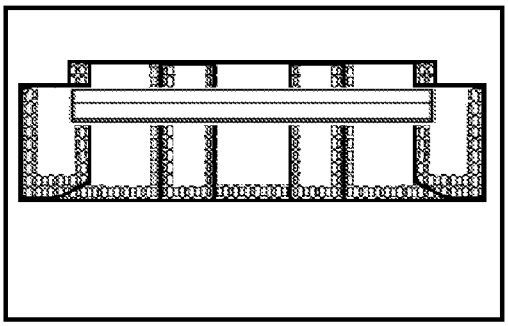
Figure 17:
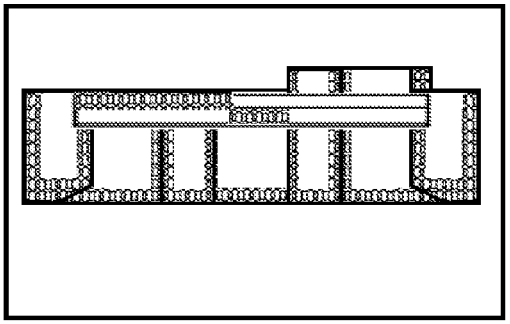
Figure 17:
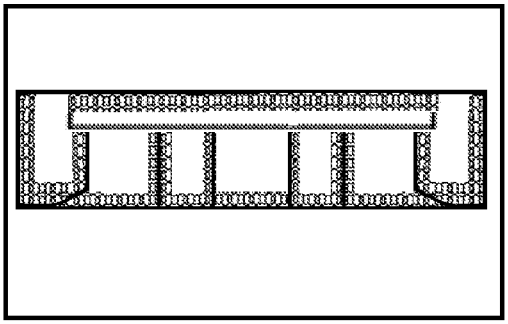
Figure 17:
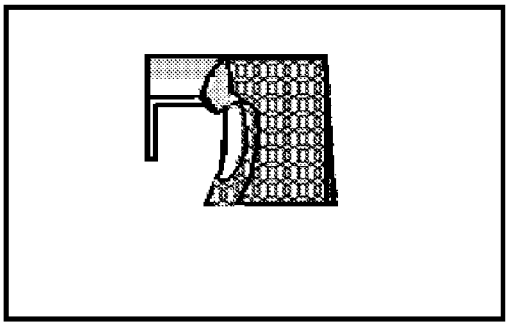
Figure 17:
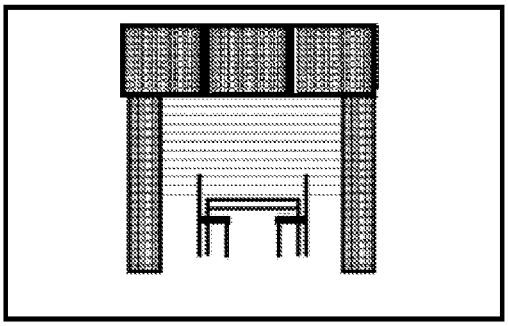

By way of a most preferred embodiment as shown in FIG. 17, a customizable modular valence design consisting of separate return (left/right) panels; divider panels; boxed pleat panels; and grommet panels may be prepared from a preferred kit as follows:

(a) the longitudinal width of the window to be covered is measured;

(b), (c) desired modular fabric components are assembled from a modular fabric component set included with the preferred kit;

(d) desired mounting brackets for positioning and supporting the channel beam 20 above the measured window are selected (in FIG. 17, a pair of offset brackets 110 are selected);

(e) the channel beam 20 is cut to a longitudinal length substantially equal to or greater than the longitudinal width of the windows;

(f) the end wall portions 170 are secured to longitudinally opposed ends of the cut channel beam 20 with screws;

(g) hook-and-loop fasteners are applied to outer and/or upper surfaces of the end wall portions 170 with an adhesive;

(h) the pair of offset brackets 110 are secured to a mounting surface above the measured window at a pre-selected longitudinal distance from each another; offset brackets 110;

(j) the curtain rod 90 is inserted through the rings or eyelets provided on the grommet panels, and thereafter mounted on the hook hangers 80;

(l) individual box pleat panels are measured, folded and pressed to provide sufficient combined longitudinal width, together with the divider and return panels, to cover the front beam surface 22 and end wall portions 170 of the cut channel beam 20;

(m) the pressed box pleat panels are arranged in a side-by-side adjacent relationship;

(n) the divider and return panels are arranged to cover and overlap the outer edges of the box pleat panels to create a valance design, with the return panels located on the opposed outermost edges of the design;

(o) the channel beam 20 is positioned at a desired height (13 inches shown) and longitudinal position (6 inches inwardly from each outermost edges of the return panels) along the back of the valence design with the bottom beam surface 24 facing down;

(p), (q) an upper portion of each modular fabric components are folded over the front beam surface 26 and top front beam surface 28 to be inserted into the channel 60, and the retention member 40 is inserted into the channel 60 to secure the uppermost portion in a friction fit against an inner surface of the channel 60, such as that of the retention wall 34; and (r), (s) the channel beam 20 and the coupled valence design are mounted on the offset brackets 110, and the overhanging portions of the return panels are secured to the end wall portions 170 with hook-and-loop fasteners to complete installation.

The brackets 10, 110 are preferably manufactured from extruded aluminum or more preferably plastic, and have a width between about 1 cm to about 10 cm, and more preferably between about 2 cm to about 5 cm. The brackets 10, 110 may be in the alternative constructed from multiple components assembled or coupled together to form a final assembled form. There are no maximum quantities of brackets 10, 110 which are required per width of the window to be dressed. However, the minimum number of brackets 10, 110 to be used should be determined based on the weight of the window treatments to be supported and/or window width. More than two brackets 10, 110 may be provided for positioning on a mounting surface in a longitudinally spaced relationship to one another. It is to be understood that the specific dimensions of the brackets 10, 110 are not particularly limited.

Preferably, the channel beam 20 is formed as a plastic or metal extrusion having a typical longitudinal length of between about 30 cm to about 350 cm depending on the width of the window to be dressed. Other materials and dimensions are possible depending on the desired mechanical or aesthetic properties, and the intended load to be placed on the channel beam 20. The channel beam 20 may in the alternative be formed with multiple separate components or parts which are bonded, welded or otherwise coupled together into a final form. Wider windows may require multiple channel beams 20 arranged in end by end adjacent relationship to span across an entire width of the window to be dressed.

The retention member 40 may have any suitable cross-sectional shape including rectangular, oval or circular, and may be made from any suitable compressibly resilient material including foam and rubber materials having a sufficient density to provide the required clamping forced to maintain the valance 200 in position. In a preferred embodiment, mechanical fasteners such as adhesive hook-and-loop strips may be provided on the outer facing surfaces of the wall 34, front beam surface 26 and/or top front beam surface 28 to provide additional support in attaching the modular fabric components of the valence 200 to the channel beam 20.

If it is desired that sliding movement of the channel beam 20 relative to the brackets 10, 110 be restricted, a pair of brackets 10, 110 may be positioned at a longitudinal distance substantially equal to the length of the channel beam 20, so as to abut against the end walls 70, 170 when mounted on the brackets 10, 110. Alternatively, the slot 31 and/or groove 25 of the channel beam 20 may be truncated or discontinuous outside predetermined intervals (not shown) where the channel beam 20 is to be seated on the brackets 10, 110. To substantially or completely eliminate sliding movement of the channel beam 20, stop members (not shown) sized for insertion in the slot 31 and/or groove 25 of the channel beam 20 to abut against the retention flange 17, 117 and/or rib 16, 116 may be provided.

I claim:

1. A window treatment mounting assembly for mounting a window treatment over a window, the mounting assembly comprising:

a longitudinally elongated channel beam for releasably retaining the window treatment, the beam comprising a sidewall defining:

parallel spaced front and rear beam surfaces;

an upwardly open elongate channel between the front and rear beam surfaces;

a bottom beam surface extending from the front beam surface to the rear beam surface, the bottom beam surface defining a downwardly open elongate groove, wherein the bottom beam comprises a rearward engagement member having at least one of a slot and a lip;

a resiliently compressible retention member sized for insertion within the channel, whereby engagement between the retention member and at least part of the sidewall releasably couples the window treatment to the channel beam in a friction fit;

at least one mounting bracket for supporting the channel beam in a mounting position adjacent the window, each said at least one mounting bracket comprising:

an anchor member for securing the mounting bracket in the mounting position;

a support arm extending from the anchor member forwardly towards a forward end and defining an upwardly oriented seating surface, the support arm having a rib on the forward end sized for mated engagement in at least part of the elongate groove;

a retention flange projecting forwardly from the anchor member and spaced above the support arm to define a forwardly open channel-recess therebetween;

wherein the bottom beam surface is positionable in a mounted arrangement in abutting contact with the seating surface, with the rib in mated engagement with the elongate groove and the engagement member engaging at least one of the retention flange and the channel-recess.

2. The window treatment mounting assembly of claim 1, wherein the rib is positionable in the elongate groove under pivotal movement of the channel beam with the engagement member engaging at least one of the retention flange and the channel-recess.

3. The window treatment mounting assembly of claim 1, wherein the engagement member comprises a transverse slot for transversely sliding engagement with the retention flange and the channel-recess.

4. The window treatment mounting assembly of claim 1, wherein the channel beam further comprises a pair of longitudinally opposed end walls, each said end wall comprising a hook-and-loop fastener for releasably securing a window treatment end piece.

5. The window treatment mounting assembly of claim 1, wherein the anchor member comprises a wall attachment flange oriented substantially normal to the support arm, the wall attachment flange defining at least one hole for receiving a mechanical fastener therein.

6. The window treatment mounting assembly of claim 5, wherein the retention flange is offset forwardly from the wall attachment flange.

7. The window treatment mounting assembly of claim 5, wherein the retention flange is coupled to the wall attachment flange, and wherein when the bottom beam surface is in the mounted arrangement, the rear beam surface is in abutting contact with the wall attachment flange.

8. The window treatment mounting assembly of claim 1, wherein the mounting assembly comprises a plurality of said mounting brackets positionable in a longitudinally spaced relationship relative to one another.

9. The window treatment mounting assembly of claim 1, wherein the elongate channel, the elongate groove and the rearward engagement member are integrally formed as an extrusion.

10. A window treatment mounting assembly for mounting a window treatment, the mounting assembly comprising:

an elongate beam for releasably securing the window treatment, the elongate beam comprising a sidewall defining at least:

a rear beam surface defining an engagement slot; and a bottom beam surface defining a retaining slot; and at least one mounting bracket for supporting the elongate beam on a mounting surface, each said at least one mounting bracket comprising:

a wall flange for securing the bracket to the mounting surface;

a first arm extending forwardly from the wall flange, and defining a substantially planar upper seating surface, the first arm having an upwardly extending protrusion on a forward end sized to be received in the retaining slot; and a second arm projecting forwardly from the wall flange and spaced above the first arm to define a forwardly open channel therebetween, the second arm being sized for insertion in the engagement slot;

wherein the bottom beam surface is positionable in a mounted arrangement on the seating surface, with the second arm inserted in the engagement slot and the protrusion received in the retaining slot, whereby the beam is transversely slidable relative to the at least one mounting bracket in the mounted arrangement;

a resiliently compressible retention member, wherein the sidewall further defines at least in part an upwardly open elongate channel sized to receive the retention member therein, whereby engagement between the retention member and at least part of the sidewall releasably couples the window treatment to the beam.

11. A window treatment mounting assembly for mounting a window treatment over a window, the mounting assembly comprising:

a longitudinally elongated beam for releasably retaining the window treatment, the beam comprising a bottom beam surface, a sidewall having a rearward engagement member, the sidewall defining an upwardly open elongate channel and a downwardly open groove positioned forwardly of the engagement member;

a resiliently compressible retention member sized for insertion within the channel, whereby engagement between the retention member and at least part of the sidewall releasably couples the window treatment to the channel beam in a friction fit;

a plurality of mounting brackets positionable on a mounting surface in a longitudinally spaced relationship relative to one another to support the beam over the window, each said mounting bracket comprising:

an anchor member for securing each mounting bracket to the mounting surface;

a support arm projecting forwardly from the anchor member towards a forward end and defining an upper seating surface, the support arm having a rib on the forward end sized for mated engagement in the groove; and a retention flange coupled to the support arm and offset forwardly from the anchor member, the retention flange being substantially parallel to and spaced above the support arm to define a forwardly open channel therebetween;

wherein the bottom beam surface is positionable in a mounted arrangement in contact with the seating surface, with the rib in mated engagement with the open groove and the engagement member engaging at least one of the retention flange and the forwardly open channel.

12. The window treatment mounting assembly of claim 11, wherein the engagement member comprises a transverse slot for transversely sliding engagement with the retention flange and the forwardly open channel.

13. The window treatment mounting assembly of claim 12, wherein the anchor member comprises a wall attachment flange oriented substantially normal to the support arm, the wall attachment flange defining at least hole for receiving a mechanical fastener therein.

14. A window treatment kit comprising a window treatment and the window treatment assembly of claim 1.

* * * * *